United States Patent [19]

Knippel

[11] 4,339,222

[45] Jul. 13, 1982

[54] DOOR LOCKING MECHANISM FOR HOPPER CAR DOORS

[75] Inventor: Willis H. Knippel, Palos Park, Ill.

[73] Assignee: Pullman Incorporated, Chicago, Ill.

[21] Appl. No.: 202,533

[22] Filed: Oct. 31, 1980

Related U.S. Application Data

[63] Continuation of Ser. No. 36,891, May 7, 1979, abandoned.

[51] Int. Cl.[3] ..... B61D 7/30

[52] U.S. Cl. ..... 414/387; 105/241.1; 105/241.2; 414/388

[58] Field of Search ..... 414/387, 388, 376; 105/241.1, 241.2; 104/249, 256, 172; 246/246, 313

[56] References Cited

U.S. PATENT DOCUMENTS

| | | | |
|---|---|---|---|
| 1,594,863 | 8/1926 | Warner | 105/241.1 |
| 1,641,855 | 9/1927 | Lamont | 246/313 |
| 1,781,259 | 11/1930 | Welsh et al. | 105/241.1 |
| 2,616,576 | 11/1952 | Sanford et al. | 105/241.1 |
| 3,321,093 | 5/1967 | Arbel | 414/387 |
| 3,452,886 | 7/1969 | D'Orey | 414/387 |
| 4,051,960 | 10/1977 | Raksanyi | 414/387 |
| 4,207,020 | 6/1980 | Schuller | 105/241.2 |

FOREIGN PATENT DOCUMENTS 598320 2/1948 United Kingdom .

*Primary Examiner*—John J. Love
*Assistant Examiner*—L. E. Williams
*Attorney, Agent, or Firm*—Richard J. Myers

[57] ABSTRACT

A door locking mechanism for a hopper door includes a latch arrangement which is incorporated into a door closure mechanism activated by a side-of-track camming mechanism. The arrangement includes an actuating device responsive to car wheel engagement and a safety locking combination cooperating with the actuating mechanism.

10 Claims, 7 Drawing Figures

DOOR LOCKING MECHANISM FOR HOPPER CAR DOORS

This is a continuation of Ser. No. 036,891, filed May 7, 1979, now abandoned.

BACKGROUND OF THE INVENTION

1. Field of the Invention

The present invention relates to railway hopper cars and more specifically to a locking mechanism for the hopper car doors which is activated by a ground mounted camming device responsive to wheel engagement.

2. Description of the Prior Art

Pertinent patents of the prior art include U.S. Pat. Nos. 1,594,863, Aug. 3, 1926; 1,781,259, Nov. 11, 1930; 3,321,093, May 23, 1967; 3,452,886, July 1, 1969 and 2,616,576, Nov. 4, 1952. The present invention is an improvement over the aforementioned patents in that it shows a more efficient design for locking the clam shell doors of a hopper car which includes a gravity latching mechanism directly engageable with the horizontal arms utilized for closing the clam shell doors by a side-of-track camming mechanism. The locking mechanism also includes a car wheel actuating mechanism for placing the latch elements in an open position the same including a safety lock intended to prevent inadvertent opening of the locking mechanism while the car is in transit but which is adapted to be engaged by an improved ground mounted and wheel actuated camming mechanism.

SUMMARY OF THE INVENTION

A railway hopper car comprises a plurality of hoppers each having clam shell door arrangements which discharge the load by gravity directly below the car into suitable bins provided. The clam shell doors are retained in the lock position by means of a latching mechanism which is pivotally connected to the hopper structure and which engages horizontal outwardly and inwardly movable bars provided at their outer ends with cam followers which engage side-of-track camming devices to move the doors inwardly to their locked position after the load has been dumped. The latch mechanisms provided for each of the horizontal arms are movable by gravity into a lock position and into keeper arrangements provided on the horizontal bars. In order to open the latches to permit gravity discharge of the material contained within the car actuating mechanisms are provided which include a fixed tubular support for each of the doors and includes a sliding telescoping actuating member which by means of a suitable linkage arrangement is connected to the latch elements and pivots the same to their disengaged position, and an upward direction, as the actuating member engages a track mounted cam element which in response to wheel engagement moves the actuating members upwardly into the out-of-the-way or disengaged position. The wheel actuated camming mechanism also includes a second cam arrangement which is adapted to be engaged by a safety lock device which is moved to an out-of-the-way position by the second cam as the car approaches the dumping site. This then permits the actuating member to be engaged by another cam responsive to wheel tripping thereby moving the latch to the aforementioned open position.

DESCRIPTION OF THE PREFERRED EMBODIMENT

Figures 1, 2:
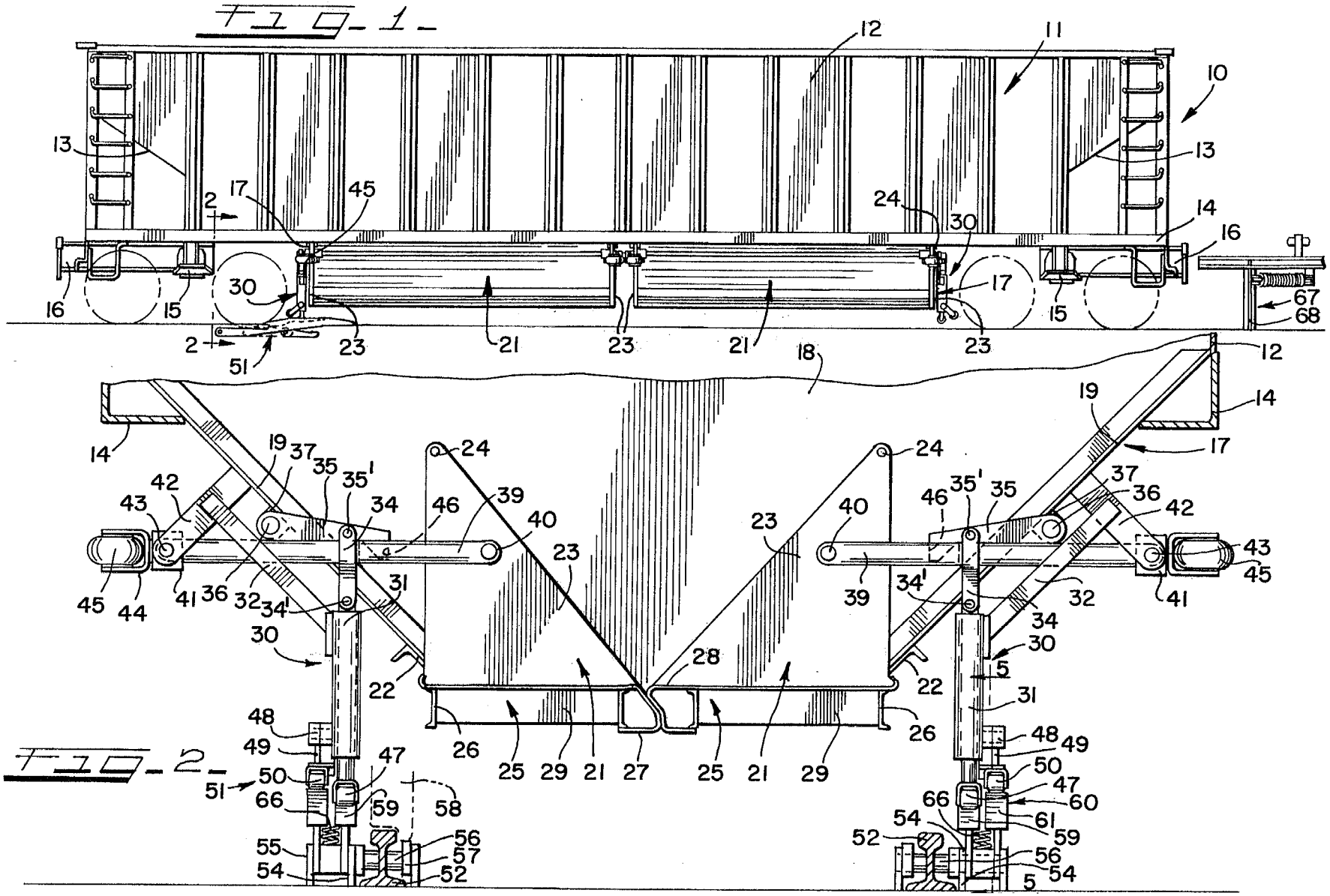
FIG. 1 is a side elevational view of a railway hopper car disclosing a side-of-track closure cam and a wheel engageable ground mounted actuating mechanism.
FIG. 2 is a cross-sectional view taken substantially along the line 2—2 of FIG. 1.

Referring particularly to FIG. 1 a railway hopper car 10 includes a car body 11 having side walls 12 and end walls 13. The side walls are provided at their lower ends with longitudinally extending side sills 14. The car includes car bolsters 15 at opposite ends thereof which are suitably supported on conventional car trucks. The bolsters 15 are also supported on end stub sills 16 in conventional fashion.

The car includes longitudinally spaced hopper structures designated at 17 provided with vertical end walls 18 and downwardly and inwardly extending slope sheets 19 spaced apart to define discharge openings 20. The type of hoppers disclosed are particularly adapted for discharging comminuted types of materials such as coal, grain, wood chips, etc. A pair of clam shell type doors 21 are provided for each of the hopper structures 17. The slope sheets 19 are provided with longitudinally extending channel reinforcing beams 22 adjacent to the discharge openings 20. A pair of clam shell doors designated at 21 are suitably hingedly connected to the vertical end walls 18 by means of hinge hangers 23 having hinged pivot members 24. Each of the doors 21 also includes bottom door panels 25 provided with horizontal rear beams 26 and frontal interengaging beams 27 and 28. The beams 26 and 27 are interconnected by transfer support members 29.

Figures 3, 5:
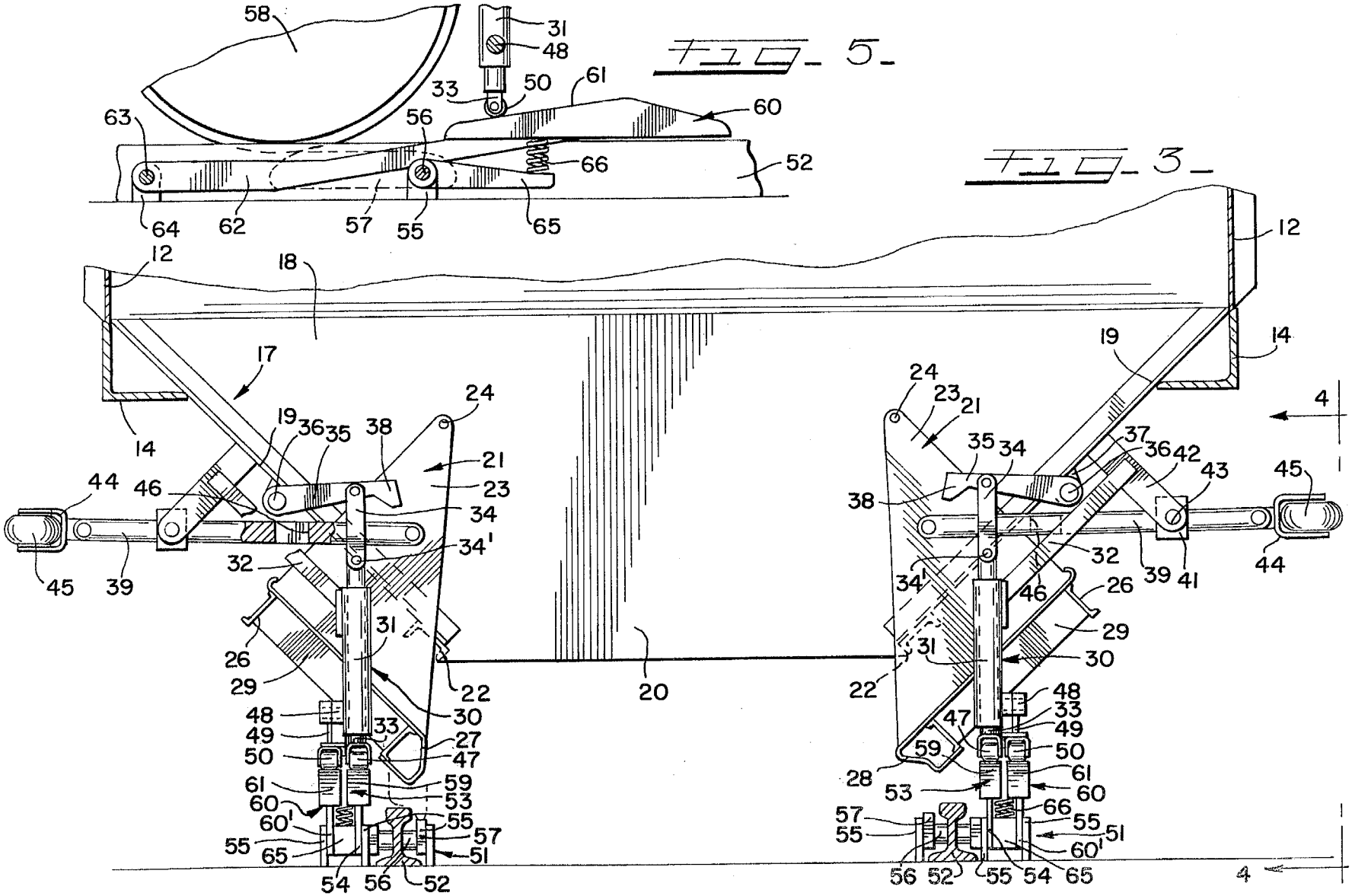
FIG. 3 is an enlarged view similar to FIG. 2 showing hopper car doors and actuating mechanism in an open position.
FIG. 5 is an elevational view taken substantially along the line 5—5 of FIG. 2.
Figure 6:
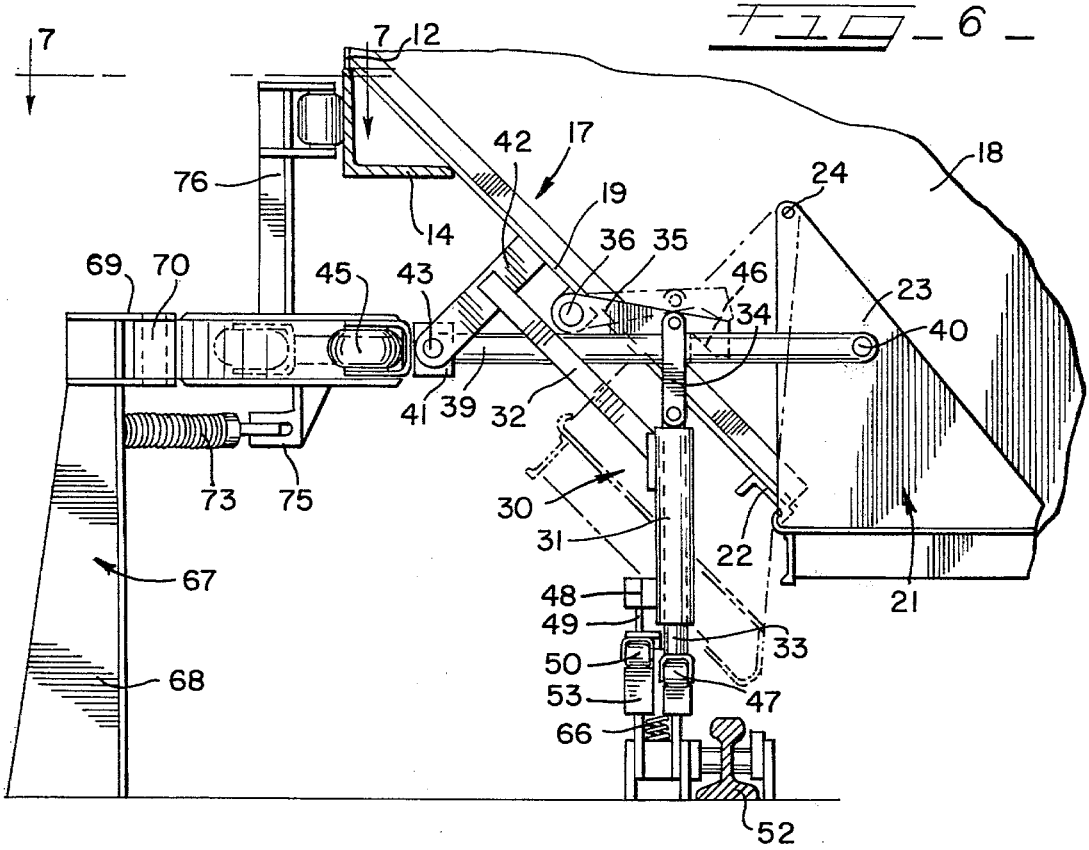
FIG. 6 is a fragmentary elevational view showing a door locking mechanism inside of track mounted closure device adapted to swing the door to a closed position.

As best shown in FIGS. 2, 3 and 6 a door locking mechanism 30 comprises a vertical tube 31 supported on each of the hopper structures or slope sheets 19 by means of brackets 32. As best shown in FIG. 1 a door locking mechanism 30 is provided for each door and is mounted on the hopper structure at one end of each door. A telescoping sliding actuating member 33 is slidably disposed in each vertical tube 31 and is connected to a pair of pivot links 34 by pivots 34'. A latch member 35 is pivotally connected to each of the hopper structures by means of a pivot 36 supported on a bracket 37 in turn connected to the slope sheets 19. Each latch member 35 includes pivot means 35' pivotally connecting the same to the pivot links 34. Each of the latch members is provided with a hook shaped latch end 38 as best shown in FIG. 3. A horizontal arm 39 is provided for each door and is pivotally connected to each door as indicated at 40. The horizontal arm 39 extends through and is in sliding engagement with a bushing guide 41 suitably pivotally connected to a bracket 42 by means of a pivot member 43. The arm extends outwardly of the bushing guide 41 and has connected thereto a U-shaped follower bracket 44 within which a follower wheel 45 is rotatably positioned. Each of the horizontal arms 39 are provided with a keeper notch 46 which is adapted to be engaged by the hook-shaped latch end portions 38 for locking the doors in the closed position.

Figure 4:
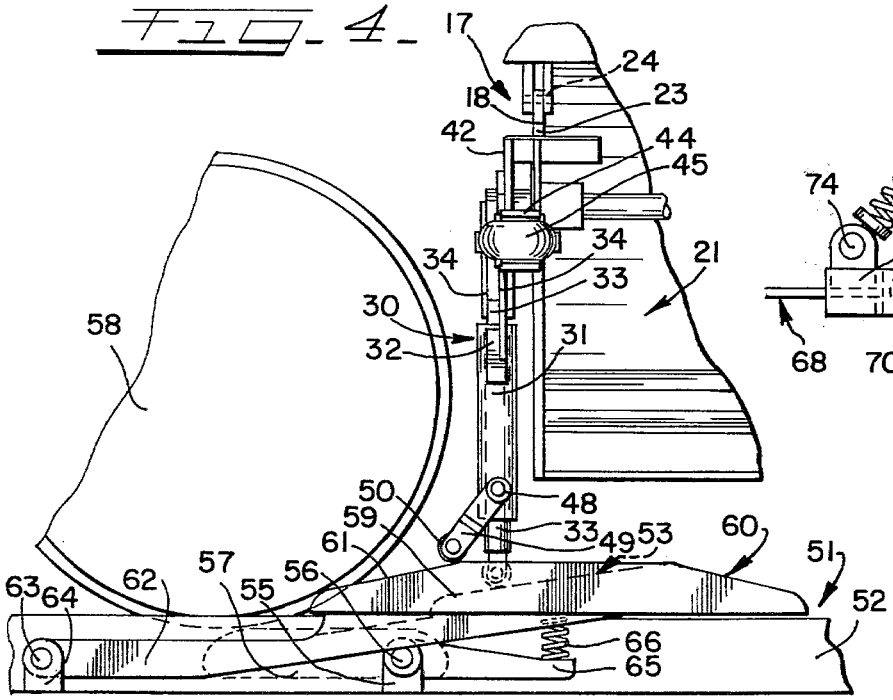
FIG. 4 is a side elevational view of a portion of a locking mechanism taken substantially along the line 4—4 of FIG. 3.

As best shown in FIG. 3 each of the sliding actuating members 33 is provided at its lower end with a cam follower 47. A pivot bracket 48 connected to the lower end of each vertical tube 31 supports for pivotal movement a stop link 49 having at its lower end a follower wheel 50. A track mounted or ground mounted camming mechanism 51 is best shown in FIGS. 4 and 5 and is positioned adjacent to one of the rails 52 of a conventional track. The mechanism 51 comprises an inner cam 53 having a lower pivot plate 54 pivotally mounted on ears 55 by means of a pivot shaft 56. A pivot lever 57 is also connected to the pivot pin 56 and is suitably mounted for pivotal movement on the vertical supports or ears 55. As best shown in FIGS. 3, 4 and 5 a car wheel 58 is adapted to engage the lever 57 for rotating the shaft 56 which in turn provides for hinging and raising movement of the inner cam 53 and cam surface 59 into engagement with the cam follower wheel 47 moving the actuating arm 33 upwardly lifting the latch member 35 out of its locking position.

The track mounted cam mechanism 51 includes a second outer cam 60 having a cam surface 61 as best shown in FIG. 4. The outer cam 60 is connected to an arm 62 which in turn is pivoted as indicated at 63 to a ground mounted pivot support 64. A spring arm 65 is supported on the shaft 56 and is disposed between the pivot plate portion 54 of the inner cam 53 and a pivot plate portion 60' connected to the cam 60. A spring 66 engages the underneath sides of each of the cams 53 and 60 urging them to the raised position as shown in FIG. 4 upon engagement of the wheel 58 with the shaft 56 for moving the end of the spring arm 65 to the raised position.

Figure 7:
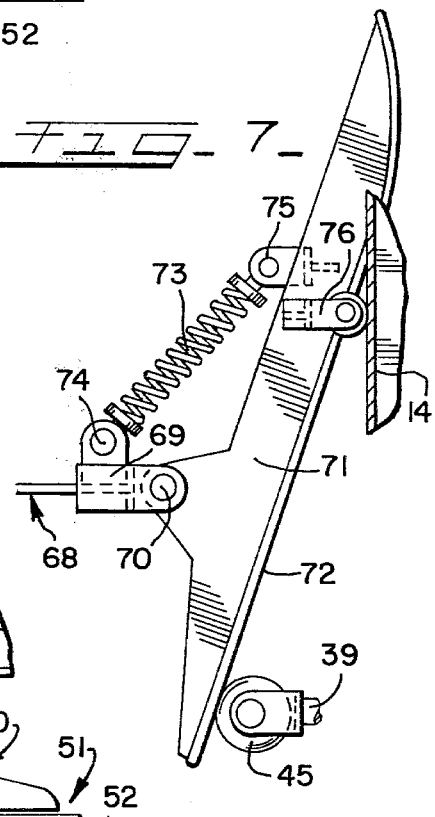
FIG. 7 is a partial sectional view taken substantially along the line 7—7 of FIG. 6.

Referring now particularly to FIGS. 6 and 7 a closing cam arrangement 67 includes a vertical ground mounted support 68 having at its upper end a clevis 69 which supports a pivot 70 for hinging movement of a cam arm 71. The cam arm 71 includes a vertical cam surface 72. A spring 73 suitably connected to a bracket 74 on the clevis 69 is also connected at its opposite ends to a pivot bracket 75 in turn connected to the arm 71. The arm 71 is provided with a guide wheel arrangement 76 adapted to engage the outer surface of the side sills 14 as best shown in FIG. 6 for swinging the doors 21 inwardly to their closed position by the follower wheel 45 engaging the camming surface 72 and being forced inwardly thereby closing said doors.

THE OPERATION

As the railway car 10 moves to the dump position one of the car wheels 58 engages the track or ground mounted cam mechanism 51 as best shown in FIGS. 3 and 4. Initially, the stop link 49 is in vertical alignment with the actuating member 33 and follower wheel 47 preventing any upward movement of the actuating member 33 since vertical forces would be restrained by the vertical position of the stop link 49. The stop link 49 and cam follower 50 as the cam follower 50 engages the camming surface 61 is moved to the position shown in FIG. 4 whereupon the cam follower 49 now slides or rides upon the camming surface 59 of the cam 53. The lever 57 has raised the spring arm 65 and 66 to the position of the cams as shown in FIG. 4 and the actuating member 33 is now moved and forced upwardly in the tubular guide 31 whereupon the links 34 move the latch elements 35 to the disengaged position shown in FIG. 3, the hook-shaped portions 38 having been moved outwardly of the keeper notches 46 of the arms 39. The load within the car is now dumped by gravity pushing the doors and associated mechanisms to the position shown in FIG. 3 whereupon the load is now freely dumped. The car is now moved into position relative to the side of track closing mechanisms 67 after both of the hoppers have been dumped and the ground mounted cam mechanisms 51 are returned to their normal non-operating position. As the guide wheel 76 is now in sliding engagement with the side sills 14 of the car and the follower wheel 45 is in position as shown in FIG. 7 continued movement of the car provides for an inward force against the arms 39 whereupon they are again pushed inwardly to close the doors and whereupon the latch members 35 again assume their locked position shown in FIG. 2. Thus the doors are now again securely locked and the lock link 49 is returned to its vertical position limiting any vertical force which might be applied against the actuating member 33.

What is claimed is:

1. In a railway hopper car having a hopper structure including downwardly and outwardly diverging slope sheets and outer side walls defining with said slope sheets a discharge opening, a door hingedly connected to said hopper structure and movable outwardly from closed to open position, the improvement of a door locking mechanism comprising, a vertical guide member, a bracket means connecting said vertical guide member to said hopper structure, an actuating member slideably supported on said vertical guide member, a latch member pivotally supported on said hopper structure and connected to said actuating member, a horizontal arm connected to said door, second bracket means on said hopper movably supporting said arm for horizontal movement, keeper means on said horizontal arm adapted to be engaged by said latch member for locking said doors in a closed position, and ground mounted actuating means adapted to engage said actuating member to move the same vertically disengaging said latch member from said horizontal arm whereby said horizontal arm is adapted to move horizontally moving said door to an open position.

2. The invention in accordance with claim 1, said latch member being movable by gravity into engagement with said keeper means upon movement of said door to its closed position.

3. The invention in accordance with claim 2, said horizontal arm including a cam follower adapted to engage a ground mounted camming means for moving said arm horizontally and said doors to a closed position.

4. The invention in accordance with claim 1, said latch member including a pivoted link pivotally connected to said actuating member.

5. The invention in accordance with claim 1, said second bracket means including a support supporting said arm for horizontal sliding movement.

6. The invention in accordance with claim 1, said horizontal arm including pivot means connecting the same to said door.

7. The invention in accordance with claim 1, said ground mounted actuating members comprising a pivotal cam member, a cam follower on said actuating member, and means on said pivoted cam member engageable by a railroad car wheel for pivoting said cam member into engagement with said cam follower for moving said actuating member and said latch member to a disengaged position relative to said keeper means.

8. The invention in accordance with claim 7, including a locking means on said vertical guide member restraining said actuating member against sliding movement.

9. The invention in accordance with claim 8, said locking means including pivot means connecting the same for pivotal movement to said vertical guide members, and a second pivoted cam member movable with said first cam member to move said locking means to an out-of-the-way position whereby said first cam member moves said actuating member to said disengaging position.

10. The invention in accordance with claim 9, said locking means including a second cam follower engageable by said second cam.

* * * * *